US006582344B2

(12) United States Patent
Tang

(10) Patent No.: US 6,582,344 B2
(45) Date of Patent: Jun. 24, 2003

(54) ROTARY STEP EXERCISER

(76) Inventor: Jack Tang, 1F, No. 7, Alley 27, Lane 247, Chang Cheng Rd., Hsin Tien City, Taipei Hsien (TW)

( * ) Notice: Subject to any disclaimer, the term of this patent is extended or adjusted under 35 U.S.C. 154(b) by 10 days.

(21) Appl. No.: 10/014,872

(22) Filed: Dec. 14, 2001

(65) Prior Publication Data

US 2003/0064864 A1 Apr. 3, 2003

(30) Foreign Application Priority Data

Oct. 2, 2001 (TW) ..... 90216708 U

(51) Int. Cl.[7] ..... A63B 22/04
(52) U.S. Cl. ..... 482/53; 482/52; 482/147
(58) Field of Search ..... 482/51–53, 79, 482/80, 146, 147, 148

(56) References Cited

U.S. PATENT DOCUMENTS

| | | | | | |
|---|---|---|---|---|---|
| 5,230,675 | A | * | 7/1993 | Lin | 482/53 |
| 5,645,512 | A | * | 7/1997 | Yu | 482/53 |
| 5,938,569 | A | * | 8/1999 | Lin | 482/52 |
| 6,179,752 | B1 | * | 1/2001 | Chang | 482/52 |

* cited by examiner

*Primary Examiner*—Stephen R. Crow
(74) *Attorney, Agent, or Firm*—Browdy and Neimark, P.L.L.C.

(57) ABSTRACT

A rotary step exerciser includes a base having an upright support, a rotary rack pivoted to the upright support, a driving shaft pivoted to the rotary rack, two pedals coupled to the driving shaft through one-way bearings, a rocker pivoted to the rotary rack and coupled between the pedals, and means coupled between the driving shaft and the upright shaft for enabling the rotary rack to be turned about the upright shaft when pedaling the pedals.

11 Claims, 8 Drawing Sheets

ROTARY STEP EXERCISER

FIELD OF THE INVENTION

The present invention relates generally to an exercising machine, and more particularly to a rotary step exerciser, which rotates when the user alternatively steps on the pedals.

BACKGROUND OF THE INVENTION

A conventional step exerciser (climber) has two pedals on which the user steps up and down alternatively with the legs. FIGS. 1 and 2 show a step exerciser according to the prior art. This structure of step exerciser 80 comprises a base frame 81, two pedals 83, a wheel unit 85, a rotary support 87, and an upright handle 89. The base frame 81 comprises transversely extended end bars 811, two longitudinal bars 812 connected between the end bars 811, and a rack 813 connected to one end bar 811 between the longitudinal bars 812. The rotary support 87 is pivoted to the rack 813. The upright handle 89 is fixedly fastened to the rotary support 87. The wheel unit 85 comprises a double groove pulley 851, a first pulley 852, a first steel-rope 853, a second pulley 854, and a second steel rope 855. The double groove pulley 851 has a rod member 856 extended from the casing thereof and fastened to a through hole 813 in one end bar 811 of the base frame 81. The first pulley 852 and the second pulley 854 are respectively mounted on the longitudinal bars 812. The first steel rope 853 has one end fixedly connected to the left pedal 83 and the other end passed through the first pulley 852 and the double groove pulley 851 and then connected to the rotary support 87. The second steel rope 855 has one end fixedly connected to the right pedal 83 and the other end passed through the second pulley 854 and the double groove pulley 851 and then connected to the rotary support 87. When the user alternatively steps the pedals 83 up and down, the upright handle 89 is alternatively rotated with the rotary upright support 87. This structure of step exerciser is functional, however it is monotonous in use. During exercising, the user constantly faces the same scene in front of the step exerciser. This monotonous exercising motion bores the user quickly.

SUMMARY OF THE INVENTION

The present invention has been accomplished under the circumstances in view. It is one object of the present invention to provide a rotary step exerciser, which rotates the user step by step when the user steps the pedals alternatively up and down.

It is another object of the present invention to provide a rotary step exerciser, which greatly attracts the user to make exercises.

To achieve these objects of the present invention, the rotary step exerciser comprises a base having an upright support with a top bevel gear, a rotary rack pivoted to the upright support, the rotary rack comprising a pivoted driving shaft, a pivoted transmission axle perpendicularly aimed at the driving shaft, a first bevel gear fixedly mounted on one end of the transmission axle and engaged with the bevel gear at the upright shaft, a second bevel gear fixedly mounted on the other end of the transmission axle, and a third bevel gear fixedly mounted on the driving shaft and engaged with the second bevel gear, two pedals coupled to the driving shaft through reversed one-way bearings, a rocker pivoted to the rotary rack and coupled between the pedals. When the user stepping the pedals alternatively up and down, the rotary rack is turned about the upright shaft step by step.

Another object of the present invention is to provide a magnetic compass having an illuminating device that has fewer structural components as well as a lower production cost and malfunction rate.

To achieve the above objects, the magnetic compass of the present invention comprises a base, a compass assembly mounted on the base, a lid pivoted to one end of the base, and an aiming device pivoted to the other end of the base. The aiming device is provided with a magnifying glass, a lighting element and a battery set. The light of the lighting member is projected towards the compass assembly and the battery set supplies electrical current to the lighting member.

DETAILED DESCRIPTION OF THE INVENTION

Figure 1:
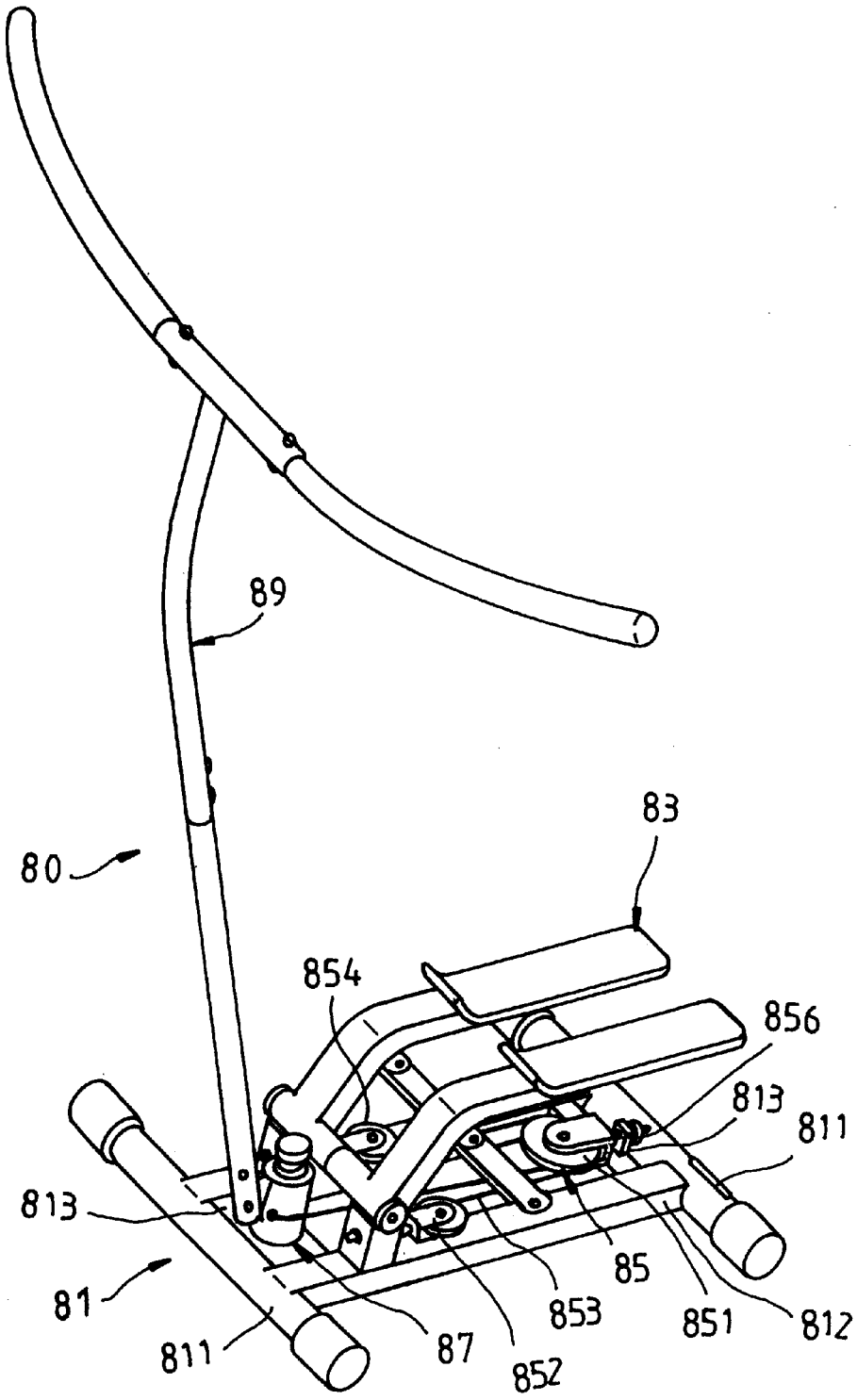
FIG. 1 PRIOR ART
FIG. 1 is a perspective view of a step exerciser (climber) according to the prior art.
Figure 2:
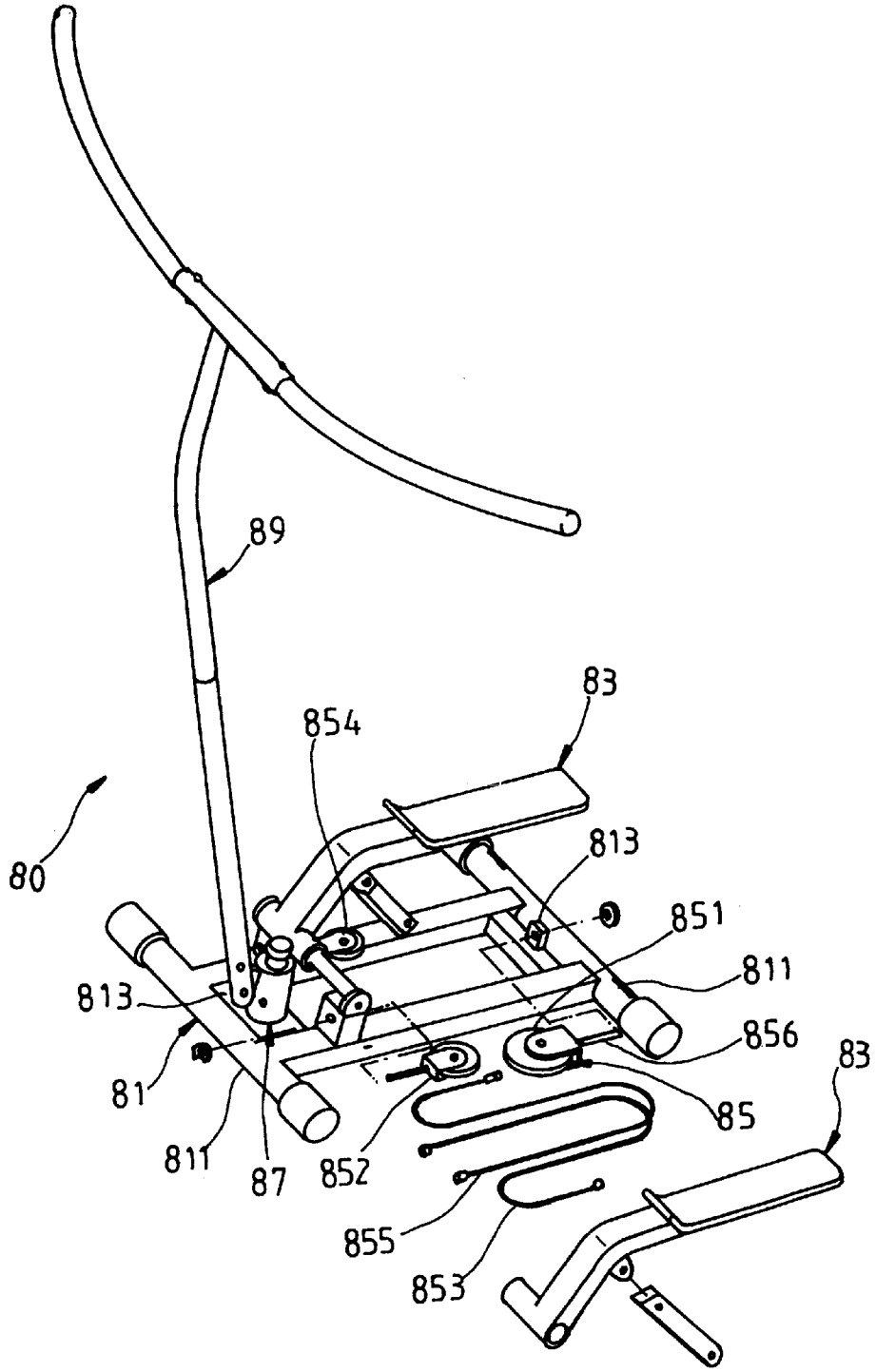
FIG 2 PRIOR ART
FIG. 2 is an exploded view of the step exerciser shown in FIG. 1.
Figure 3:
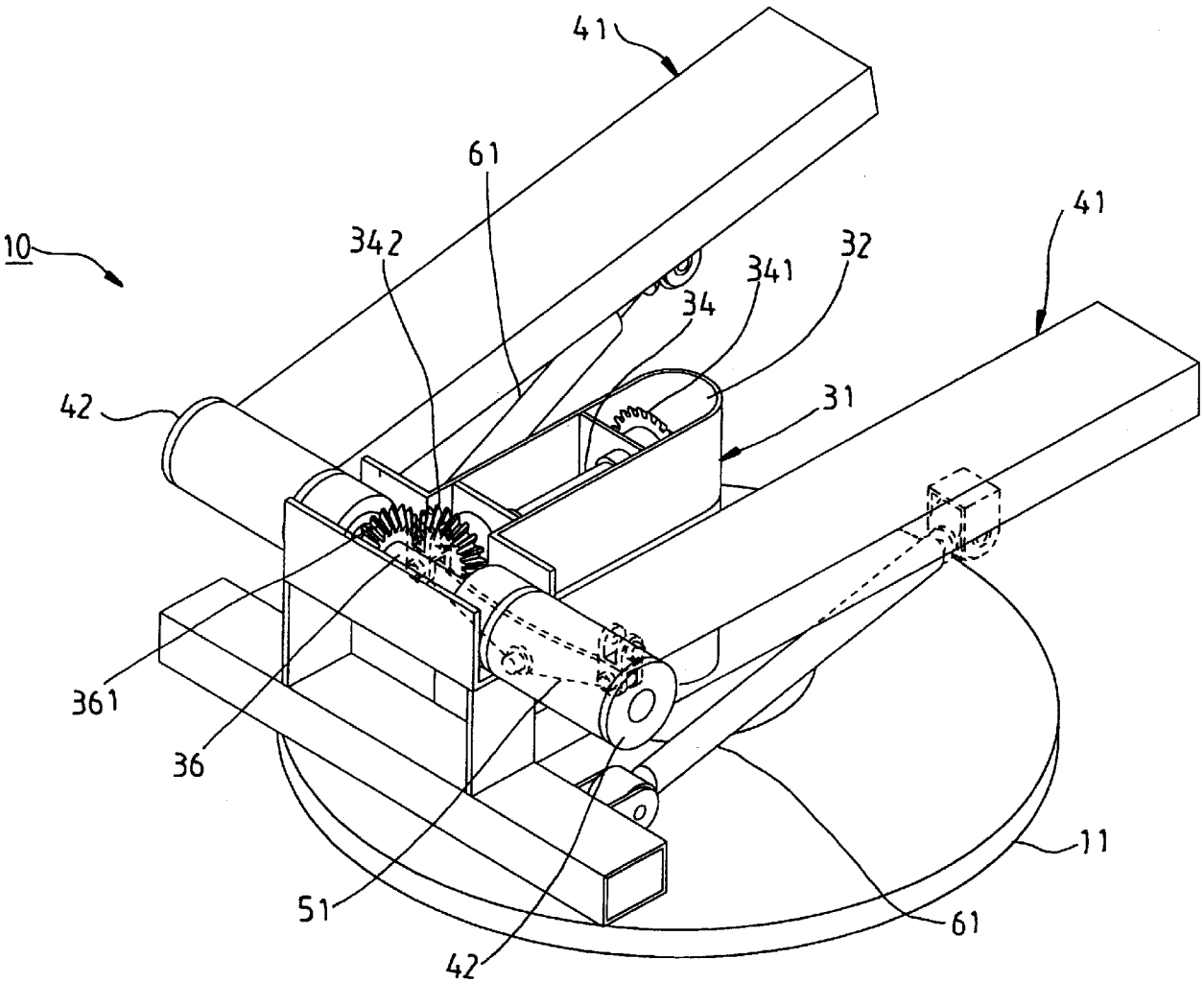
FIG. 3 is an exploded view of a rotary step exerciser according to a first embodiment of the present invention.
Figure 4:
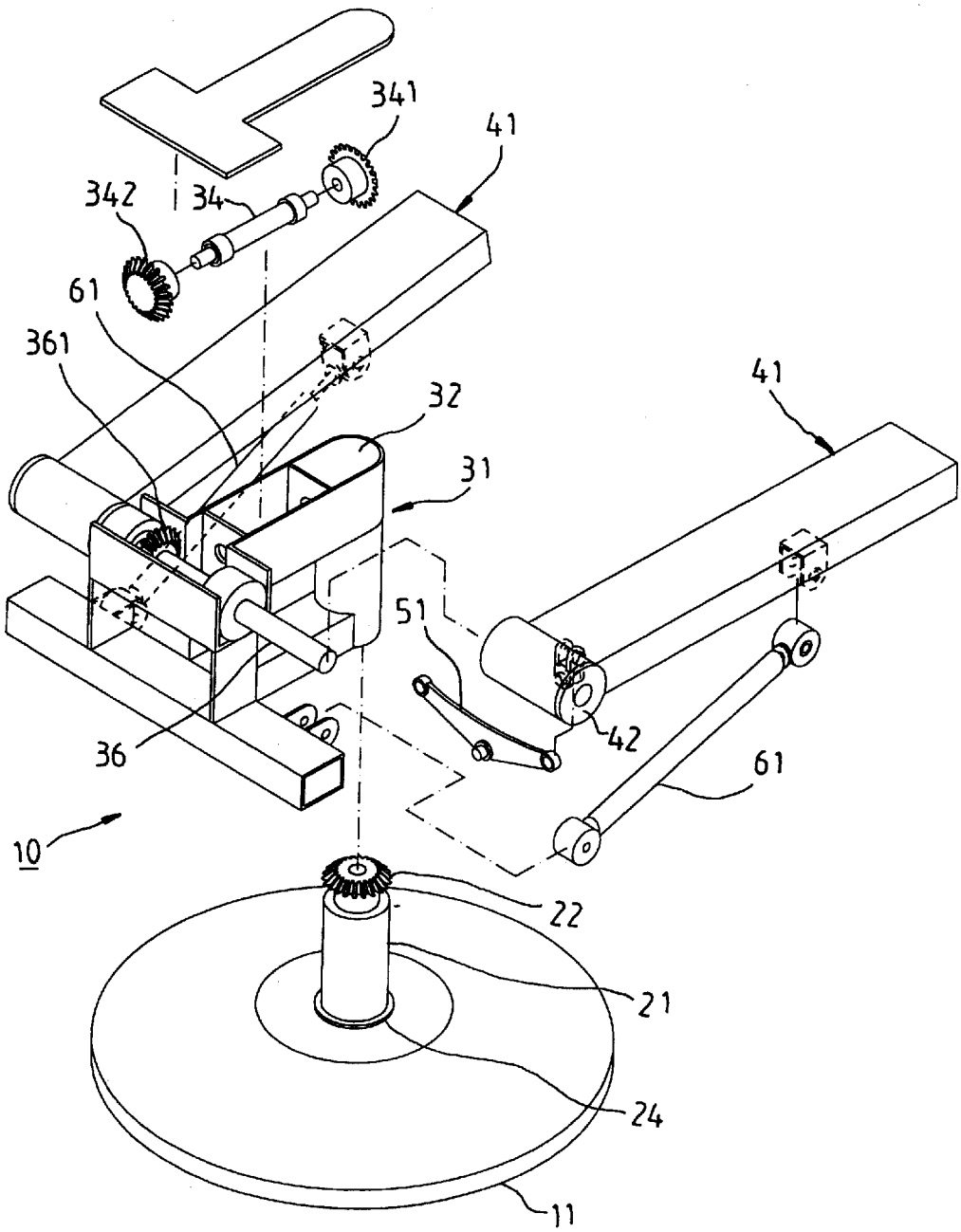
FIG. 4 is a perspective view of the rotary step exerciser according to the first embodiment of the present invention.
Figure 5:
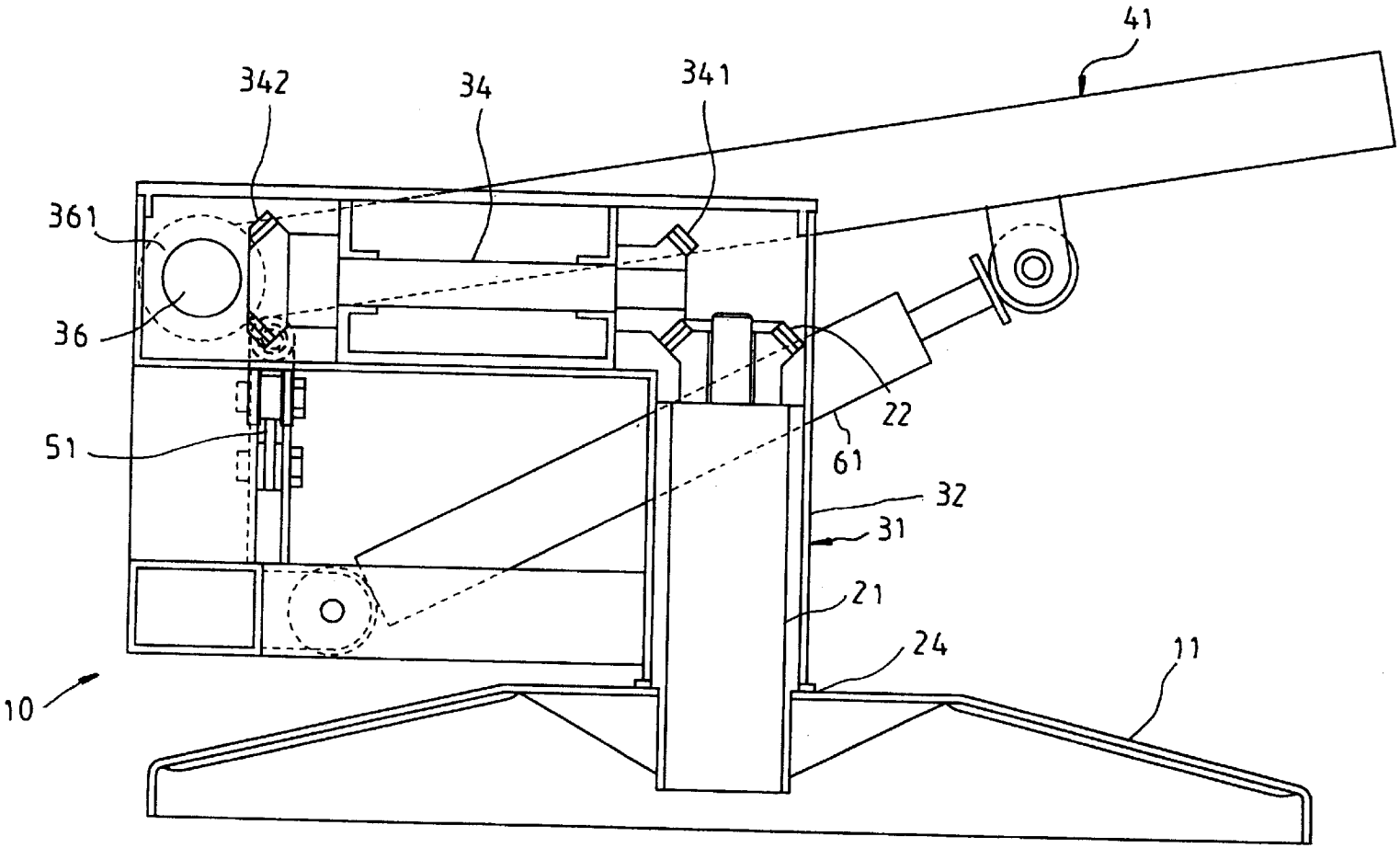
FIG. 5 is a side view in section of the rotary step exerciser according to the first embodiment of the present invention.
Figure 6:
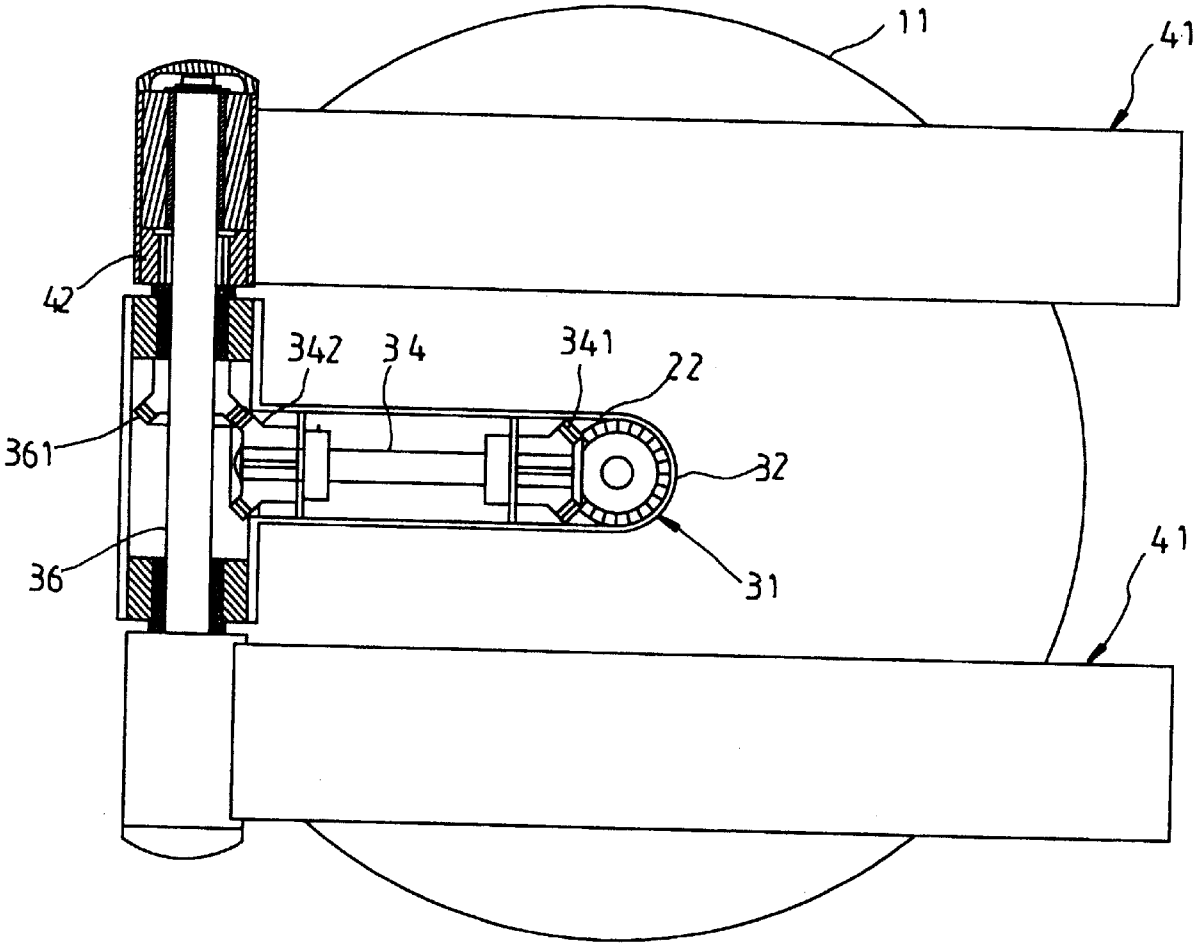
FIG. 6 is a top view of the rotary step exerciser according to the first embodiment of the present invention.

Referring to FIGS. from 3 through 6, a rotary step exerciser 10 according to a first embodiment of the present invention is shown comprised of a base 11, an upright shaft 21, a rotary rack 31, two pedals 41, and a rocker 51.

The base 11 is flat circular member to be positioned on the floor positively.

The upright shaft 21 is fixedly fastened to the center of the base 11 at the top, having a toothed engagement device, for example, a bevel gear 22 provided at the top side and a stop ring 24 provided around the periphery at the bottom side above the base 11.

The rotary rack 31 comprises a coupling shell 32 coupled to the upright shaft 21 and supported on the stop ring 24, a driving axle 36 horizontally pivotally provided outside the coupling shell 32, a transmission axle 34 horizontally pivoted to the inside of the coupling shell 32 near the top and perpendicularly aimed at the driving axle 36, a first bevel gear 341 fixedly mounted on one end of the transmission axle 34 and engaged with the bevel gear 22 at the upright shaft 21, a second bevel gear 342 fixedly mounted on the other end of the transmission axle 34 outside the coupling shell 32, and a third bevel gear 361 fixedly mounted on the driving shaft 36 and engaged with the second bevel gear 342.

The pedals 41 have at least one coupled to the driving shaft 36. According to this embodiment, the pedals 41 each have one end provided with a one-way bearing 42 respectively coupled to two ends of the driving shaft 36. The one-way bearings 42 of the pedals 41 are reversed so that the pedals 41 can be alternatively stepped up and down to rotate the driving shaft 36 in one direction. Due to the fact that the one-way bearing is a prior art, detailed description thereof is not necessary.

The rocker 51 has a middle part pivoted to the rotary rack 31, and two distal ends respectively pivoted to the pedals 41 such that when one pedal 41 is lowered, the rocker 51 is turned in one direction to lift the other pedal 41.

This embodiment further comprises two damping devices, for example, hydraulic cylinders 61 bilaterally coupled between the pedals 41 and the rotary rack 31 and adapted to impart a damping resistance to the pedals 41.

Figure 7:
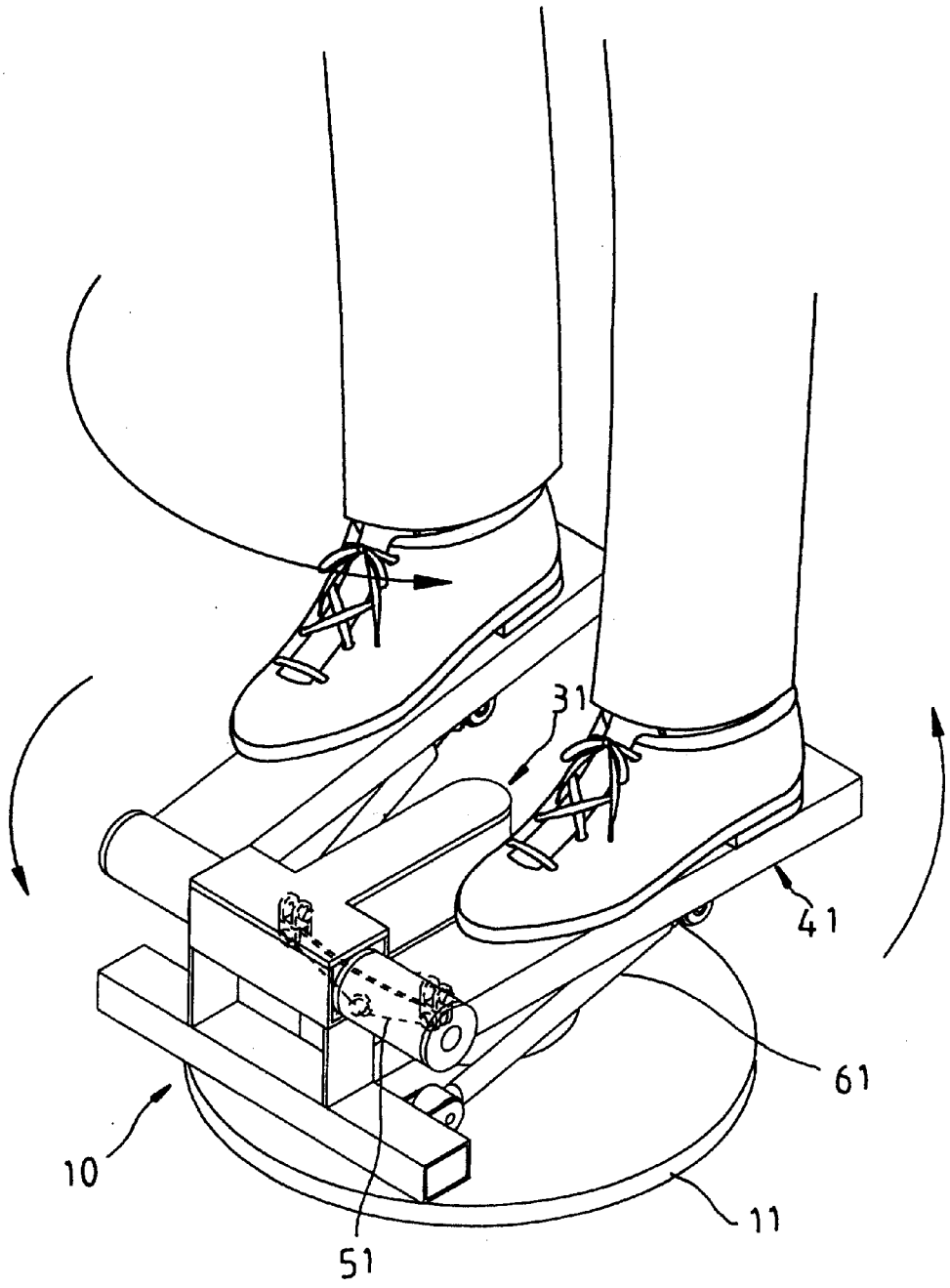
FIG. 7 is a schematic view of the rotary step exerciser in operation according to the first embodiment of the present invention.

As shown in FIG. 7, when in use, the user alternatively steps the pedals 41 up and down. When the user steps down the right pedal 41, the rocker 51 is forced to lift the left pedal 41, and at the same time the one-way bearing 42 of the right pedal 41 rotates the driving shaft 36 through an angle, the one-way bearing 42 of the left right pedal 41 runs idle. During up and down motion of the pedals 41, the hydraulic cylinders 61 impart a damping resistance to the pedals 41. During the rotary motion of the driving shaft 36, the third bevel gear 361 is rotated with the driving shaft 36 to rotate the second bevel gear 342 and the transmission axle 34. Because the first bevel gear 341 is engaged with the bevel gear 22 at the upright shaft 21, the rotary motion of the transmission axle 34 causes the rotary rack 31 to be turned about the upright shaft 21 (according to this embodiment, the rotary rack 31 is moved through 5~10° upon one stroke of either pedal 41).

When the user steps down the left leg to lower the left pedal 41, the rocker 51 is forced to lift the right pedal 41. At this time, the one-way bearing 42 of the left pedal 41 is forced to rotate the driving shaft 36, and the one-way bearing. 42 of the right pedal 41 runs idle, and therefore the rotary rack 31 is turned about the upright shaft 21 through a predetermined angle. When continuously stepping the pedals 41 up and down, the rotary rack 31 is continuously turned about the upright shaft 21 step by step.

Figure 8:
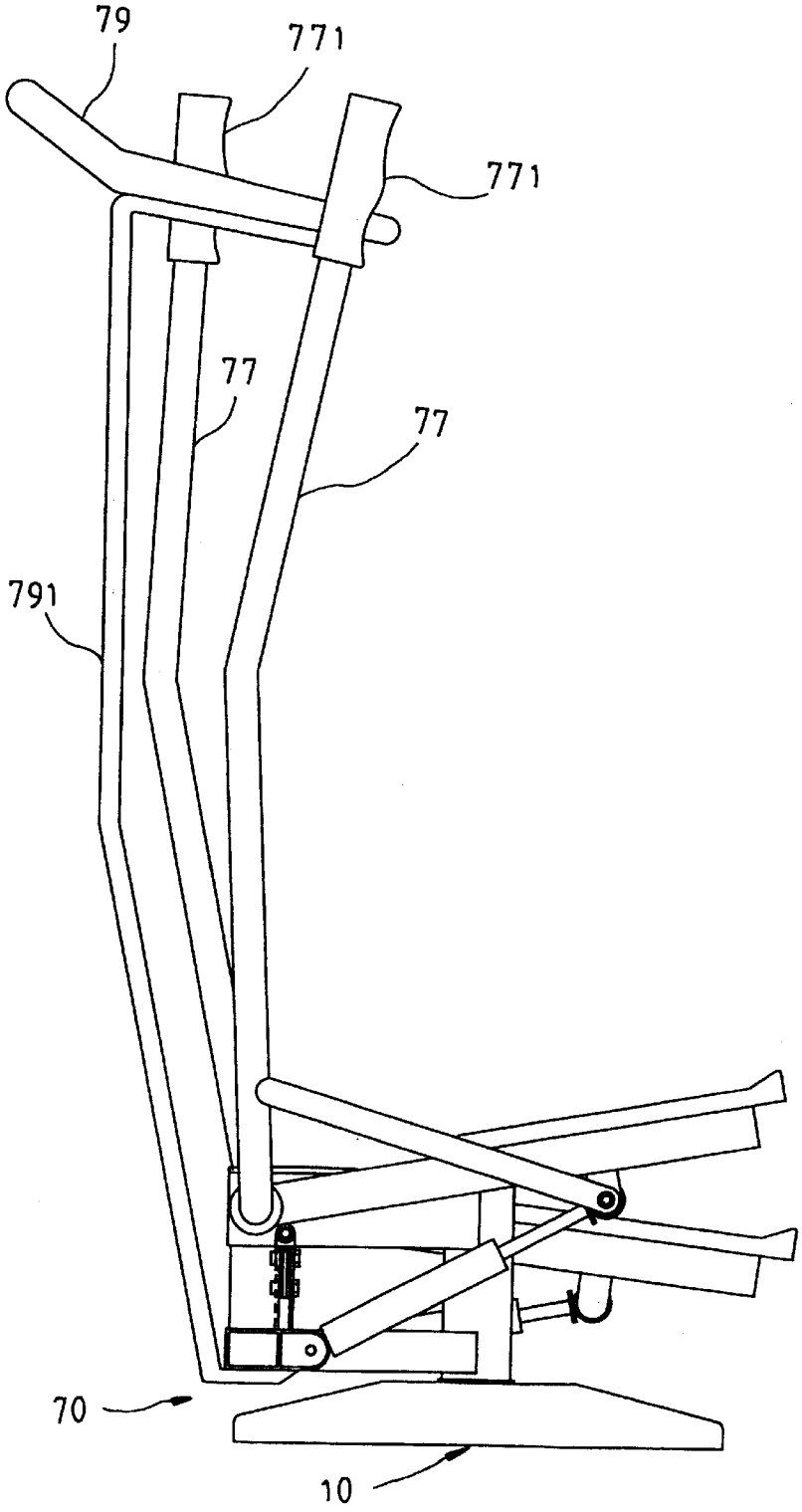
FIG. 8 is a side view of a rotary step exerciser according to a second embodiment of the present invention.

FIG. 8 shows a rotary step exerciser 70 constructed according to a second embodiment of the present invention. This embodiment adds two handles 77 and one display panel 79 to the rotary step exerciser 10 of the aforesaid first embodiment of the present invention. The handles 77 each has a bottom end respectively connected to the pedals 41 and a top end covered with a soft grip 771. The display panel 79 is supported on an upright frame 791 in the middle of the front side of the rotary rack of the rotary step exerciser 10. The handles 77 enable the user to operate the rotary step exerciser stably and safely. The display panel 79 is adapted to provide exercising information to the user.

What is claimed is:

1. A rotary step exerciser comprising:

a base;

an upright shaft fixedly fastened to a top side of said base, said upright shaft having a top side fixedly mounted with a toothed engagement means;

a rotary rack rotatably pivoted to said upright shaft, said rotary rack comprising a driving axle pivoted thereto, a transmission axle pivoted thereto, a first gear fixedly mounted on one end of said transmission axle and engaged with said toothed engagement means of said upright shaft, a second gear fixedly mounted on an opposite end of said transmission axle, and a toothed engagement means fixedly mounted on said driving shaft and engaged with said second gear;

two pedals respectively pivoted to said rotary rack at two opposite sides, said pedals including at least one pedal having one end fixedly mounted with an one-way coupling means coupled to said driving shaft;

a rocker having a middle part pivoted to said rotary rack, and two distal ends respectively pivoted to said pedals for enabling said pedals to be alternatively moved up and down when the user steps on said pedals.

2. The rotary step exerciser as claimed in claim 1 further comprising at least one damping device coupled between one of said pedals and said rotary rack.

3. The rotary step exerciser as claimed in claim 2 wherein said damping device is a hydraulic cylinder.

4. The rotary step exerciser as claimed in claim 1 wherein said pedals each have one end fixedly mounted with an one-way coupling means coupled to two ends of said driving shaft respectively.

5. The rotary step exerciser as claimed in claim 4 wherein the one-way coupling means is a one-way bearing.

6. The rotary step exerciser as claimed in claim 1 wherein said upright shaft comprises a bottom stop ring disposed around the periphery thereof above said base, and said rotary rack comprises a hollow coupling shell horizontally rotatably pivoted to said upright shaft and supported on said stop ring.

7. The rotary step exerciser as claimed in claim 1 wherein said transmission axle is pivoted to the inside of said rotary rack in horizontal.

8. The rotary step exerciser as claimed in claim 1 wherein the toothed engagement means of said upright shaft is a gear.

9. The rotary step exerciser as claimed in claim 1 wherein the toothed engagement means at said driving shaft of said rotary rack is a gear.

10. The rotary step exerciser as claimed in claim 1 further comprising two handles, said handles each having a bottom end respectively connected to said pedals.

11. The rotary step exerciser as claimed in claim 1 further comprising an upright frame fixedly connected to said rotary rack, and a display pedal supported on said upright frame.

* * * * *